United States Patent [19]

Marsik

[11] Patent Number: 4,863,287

[45] Date of Patent: Sep. 5, 1989

[54] WAXED BAG WITH WAX-FREE AREA

[75] Inventor: Ronald Marsik, Willow Springs, Ill.

[73] Assignee: Bagcraft Corporation of America, Chicago, Ill.

[21] Appl. No.: 239,207

[22] Filed: Aug. 30, 1988

Related U.S. Application Data

[62] Division of Ser. No. 130,618, Dec. 9, 1987.

[51] Int. Cl.[4] ..... B65D 30/08; B65D 30/20

[52] U.S. Cl. ..... 383/113; 383/82; 383/89; 383/116; 229/3.1

[58] Field of Search ..... 383/88, 89, 90, 113, 383/82, 83, 116; 229/3.1, 48 T; 206/811, 813

[56] References Cited

U.S. PATENT DOCUMENTS

| | | | |
|---|---|---|---|
| 599,219 | 2/1898 | Bunker | 383/90 |
| 1,128,192 | 2/1915 | Smith | 383/90 |
| 1,747,189 | 2/1930 | Seiler | 229/3.1 |
| 1,814,685 | 7/1931 | Glass | 383/90 |

*Primary Examiner*—Stephen Marcus
*Assistant Examiner*—Jes F. Pascua
*Attorney, Agent, or Firm*—Hill, Van Santen, Steadman & Simpson

[57] ABSTRACT

A paper bag having a barrier material and a method of coating paper for use in making such a paper bag. The inventive method comprises of the steps of: continuously removing in a direction of travel a strip of paper from a source of paper at a predetermined speed; masking with a liquid impervious mask at least one longitudinal portion of the strip of paper in the direction of travel; routing the strip of paper and the mask through a bath of liquid barrier material, the liquid barrier material substantially saturating the strip of paper except for the masked portion; removing the mask from the strip of paper after moving it out of the liquid barrier material; and forming a selected length of the strip of paper into the bag. The paper bag has at least a front side and a back side each having at least one longitudinal portion extending the length of the bag. The longitudinal portion has a width less than the width of the front and back sides. A barrier coating on the front and back sides of the bag is provided except on an area of the longitudinal portions of the front and back sides.

6 Claims, 1 Drawing Sheet

WAXED BAG WITH WAX-FREE AREA

This is a division of application Ser. No. 130,618, filed 12/9/87.

BACKGROUND OF THE INVENTION

The present invention relates in general to paper bags and a method of making paper bags and, in particular, to a method of making paper bags partially coated with a barrier material such as paraffin.

Paper bags are well known in the prior art and numerous methods are known for cutting strips of paper from a source of rolls of paper and folding paper bags therefrom.

Also well known in the prior art are numerous methods for coating paper and for applying substances such as paraffin to the paper surface. It is also known in the prior art to utilize paper which is coated with paraffin only in certain regions for packaging food products such that a controlled amount of moisture is allowed to leave the food product. For example, it is known to provide a wrapper for hot bread in which areas of the paper wrapper are uncoated so as to allow an escape of moisture buildup from the bread as it cools in the wrapper.

It is also known in the prior art for bakeries and similar establishments to provide paper bags that are coated with paraffin or similar material to retain freshness of bakery products after they are sold to a customer. A problem with these types of coated bags however is that the opening of the bag cannot. be folded over and taped shut since most tapes will not stick to the paraffin coated surface. In addition, self-adhesive labels or inked stamps cannot be used on the bag as well.

SUMMARY OF THE INVENTION

The present invention relates to a method of coating paper for use in making paper bags having a barrier material, such as paraffin. The method consists of the steps of continuously removing in a direction of travel a strip of paper from a source of paper at a predetermined speed; masking with a liquid impervious mask at least one longitudinal portion of said strip of paper in the direction of travel; routing the strip of paper and the mask through a bath of liquid barrier material, the liquid barrier substantially saturating the strip of paper except for the masked portion; removing the mask from the strip of paper after moving out of the bath of liquid barrier material; and forming a selective length of the strip of paper into the bag. Furthermore, after the strip of paper and mask are routed through the bath of liquid barrier material both the strip of paper and the mask may be compressed to meter the liquid barrier material therefrom. Also, after the mask is removed from the strip of paper the paper may be processed in order to set up the barrier material.

In a preferred embodiment of the present invention the mask is a pair of endless belts. One of the belts has a first width and is substantially centered on the strip of paper. The other belt has a second width and is located at substantially an edge of the strip of paper. When the strip of paper is formed into a bag a centered longitudinal portion on both the front and back sides of the bag are free of the paraffin.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
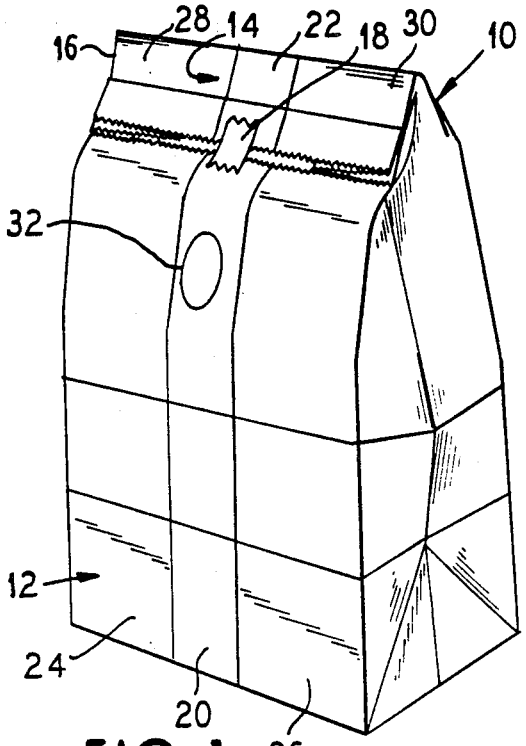
FIG. 1 is a perspective view of a novel paper bag constructed according to the method of the present invention.

The present invention has general applicability, but is most advantageously utilized in producing a novel paper bag as illustrated in FIG. 1.

The paper bag 10 has at least a front side 12 and a back side 14. As shown in FIG. 1 a top 16 of the paper bag 10 is folded over and the rear side 14 is sealed to the front side 12 by a strip of adhesive tape 18. The bag 10 as shown in FIG. 1 has a predetermined length which may vary depending upon the size of the bag, and has a substantially centrally located longitudinal portion 20 on the front side 12 and a similar portion 22 on the back side 14. Flanking longitudinal portions 24 and 26 on the front side 12 and flanking longitudinal portions 28 and 30 on the rear side 14 are coated with a barrier material such as paraffin. The central longitudinal portions 20 and 22 are free of the paraffin, thus allowing the adhesive tape 18 to adhere to the portions 20 and 22 and thereby seal the top 16 of the bag 10. Furthermore, this also allows for adhesive labels such as label 32 to be applied to the bag 10. It is envisioned that an area of the longitudinal portions 20 and 22 may also be coated with paraffin provided a sufficiently free area of the longitudinal portions 20 and 22 are uncoated near the top 16 of the bag 10 for the purposes described above.

It is well known in the prior art that a paper bag can be folded from a flat strip of paper. The paper bag 10 illustrated in FIG. 1 is folded from a strip 34 of paper shown in FIG. 2. The strip 34 of paper shown in FIG. 2 may be cut from a long strip of paper along lines 36 and 38. The strip 34 of paper has a first longitudinal portion 40 substantially centered in the strip 34 and a second longitudinal portion 42 at an edge 44 of the strip 34. These first and second longitudinal portions 40 and 42 are free of the barrier material, whereas longitudinal portions 46 and 48 are coated with the barrier material. It is to be understood that when the strip of paper 34 is folded into the paper bag 10 depicted in FIG. 1 the first longitudinal portion 40 becomes the longitudinal portion 20, the second longitudinal portion 42 becomes the longitudinal portion 22, the longitudinal portion 46 becomes the longitudinal portions 12 and 28, and the longitudinal portion 48 becomes the longitudinal portions 26 and 30. Edge 44 is sealed to edge 50 as is well known in the art of folding paper bags.

It is envisioned that one longitudinal portion could be provided or a plurality of such portions with various widths and spacings from one another could be provided. A particular combination would depend upon the desired application of the paper bag.

Figure 2:
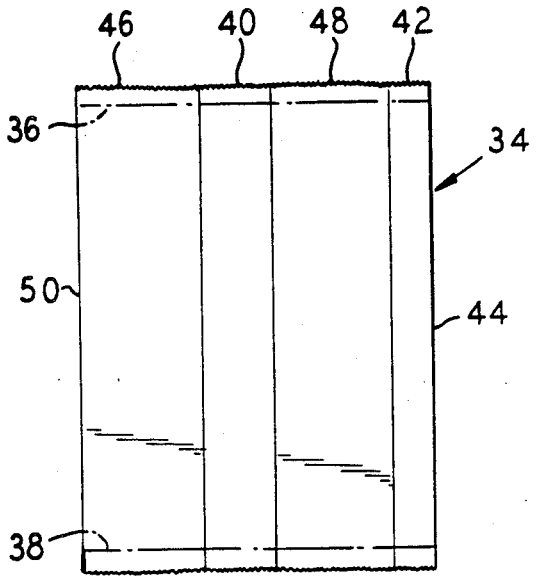
FIG. 2 is a plan view of a strip of paper used for forming the FIG. 1 paper bag.
Figure 3:
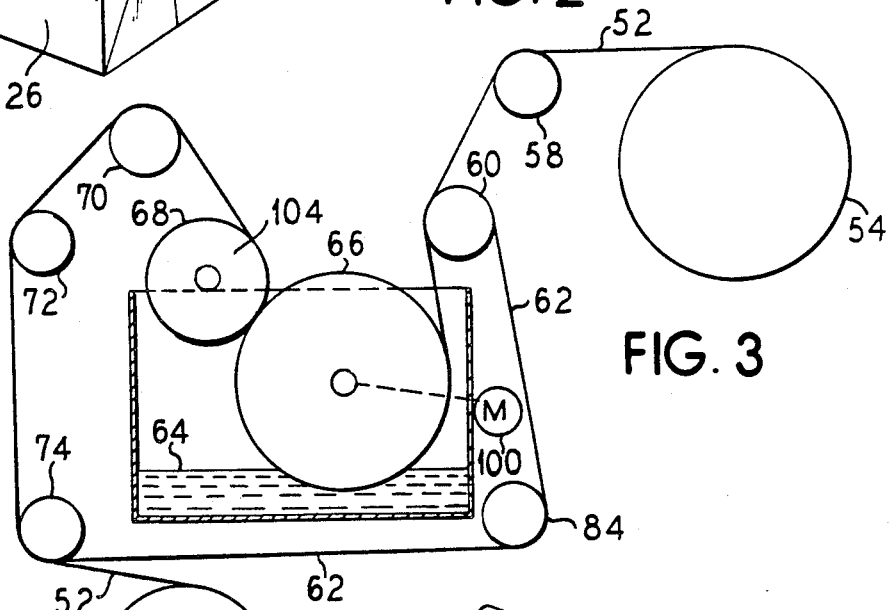
FIG. 3 is a schematic representation of a method of making the FIG. 2 strip of paper.

The method of coating the paper strip 34 is illustrated by the mechanism depicted in FIG. 3. A continuous strip 52 of paper is removed from a source of paper 54 at a predetermined speed. In the preferred embodiment the paper is a machine glazed 30-pound basis weight opaque MG type paper. The strip 52 of paper proceeds over roller 58 and at roller 60 is aligned with a liquid impervious mask 62. The strip 52 of paper and the mask 62 then are routed through a bath 64 of liquid barrier material, such as paraffin heated to 200° centigrade. The strip 52 of paper is held against a first roller 66, referred to as a steel wax roller, and the mask 62 covers the longitudinal portions 40 and 42 as shown in FIG. 2. The strip 52 of paper and the mask 62 are both routed through the bath 64 of liquid barrier material. The liquid barrier material substantially saturates the strip of paper except for the masked portions, that is the longitudinal areas 40 and 42. After the strip 52 of paper and mask 62 have been routed through the bath 64 a second roller 68, referred to as a nip roller, applies pressure against the steel wax roller 66 thereby metering the liquid barrier material from the strip 52 of paper and mask 62.

The strip 52 of paper and mask 62 then proceed over rollers 70, 72 and 74. It is to be understood, of course, that various configurations of rollers and directions of travel can be utilized with the present invention. After proceeding over roller 74, the mask 62 is removed from the strip 52 of paper. The strip 52 of paper is then moved over a chill roller 76 which sets up the paraffin or liquid barrier material. The strip 52 of paper then moves across roller 78 and into a bag forming machine 80 where the strip 52 of paper is cut into sections, such as 34 shown in FIG. 2, which are then folded into the paper bag 10 depicted in FIG. 1 using methods well known in the prior art.

The steel wax roller 66 and the chill roller 76 are driven by motors 100 and 102, respectively. The motor 100 and 102 can be resynchronized by an appropriate means. The nip roller 68 is forced against the steel wax roller 66 by, for example, adjustable spring mechanism 104.

Figure 4:
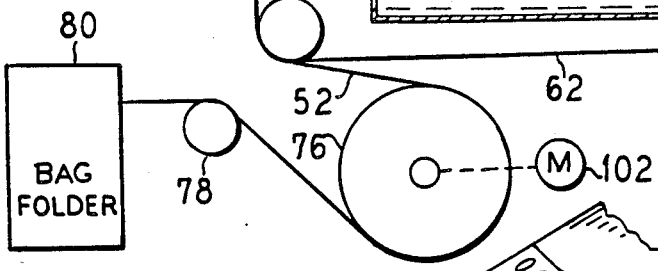
FIG. 4 is a perspective view of a part of the mechanism illustrated in FIG. 3.
Figure 4:
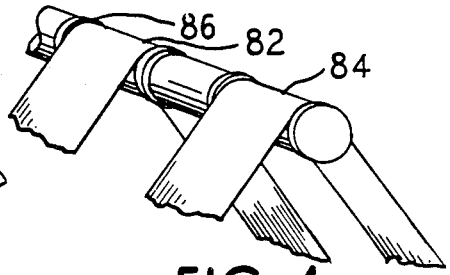

The mask 62 is an endless belt formed from a plastic or polyester material, such as 100 gauge lap sealable DuPont XM833. In order to form the masked longitudinal portions 40 and 42 as shown in FIG. 2 the endless belt or mask 62 may be constructed of two belts such as shown in FIG. 4. A first belt 82 is substantially centered and a second belt 84 is aligned with the edge portion of the strip 52 of paper. The rollers, such as rollers 60, 70, 72, 74 and 84 shown in FIG. 3 can have ridges 86 depicted in FIG. 4 for keeping the belts 82 and 84 in alignment. It is envisioned that other types of mechanisms can be utilized for aligning the mask 62, that is belts 82 and 84 with the strip 52 of paper during the coating of the strip 52. Furthermore, depending upon the application desired, one belt may be utilized for the mask 62 or a plurality of spaced belts may be utilized. The belts 84 and 82 which form the mask 62 travel at substantially the same speed as the strip 52 of paper as it is routed through the bath 64 of liquid barrier material. The steel wax roller 66 of course is partially submerged in the bath 64 of liquid barrier material. The amount that the steel roller 66 is submerged depends upon the desired application of the type of barrier material which is utilized.

Figure 5:
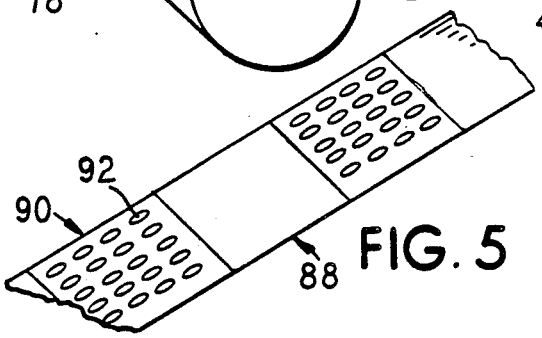
FIG. 5 is a perspective view of an alternative embodiment of a belt used in the mechanism illustrated in FIG. 3.

In an alternative embodiment, the mask 62 may utilize a belt 88 as shown in FIG. 5. This belt 88 may have areas 90 which have perforations 92 which allow the liquid barrier material to coat a portion of the longitudinal areas 20 and 22 of the paper bag 10 shown in FIG. 1. This type of belt 88 could be utilized for applications where the entire area of the longitudinal portions 20 and 22 need not be free of the liquid barrier material. As was indicated above, one or a plurality of belts 88 could be utilized in the inventive method of coating the paper for use in making the paper bag.

The paper bag 10 illustrated in FIG. 1 establishes a predetermined percentage of freshness barrier and can be particularly utilized for bakery goods. Although a 100% freshness barrier could be provided with a completely coated paper bag 10 the problem has arisen that the bag cannot be taped shut and self-adhesive labels cannot be used on such a fully coated paper bag. Therefore, the novel paper bag shown in FIG. 1 provides for the ability to tape the bag shut and apply self-adhesive labels while still providing a high percentage of a freshness barrier to protect, for example, bakery goods contained in the paper bag.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A paper bag having a predetermined length comprising;

at least a front side and a back side having substantially the predetermined length, outer surfaces of the front and back sides having at least one longitudinal portion extending the predetermined length, said longitudinal portion having a width less than a width of the front and back sides;

a barrier coating on the front and back sides of the bag except on an area of said longitudinal portions on said outer surfaces of the front and back sides.

2. The paper bag as claimed in claim 1, wherein all said area of said longitudinal portions on said outer surfaces of the front and back sides are free of said barrier material.

3. The paper bag as claimed in claim 1, wherein said barrier material is paraffin.

4. The paper bag as claimed in claim 1, wherein said longitudinal portions are substantially centered on said outer surfaces of the front and back sides.

5. A paper bag having at least one longitudinal region on at least a front and back side thereof, said paper bag coated with a barrier material on areas of said paper bag except for said longitudinal region, said paper bag folded from a strip of paper coated by masking with a liquid impervious mask first and second longitudinal portions, said first longitudinal portion substantially centered in said strip of paper and said second longitudinal portion located substantially at an edge of said strip of paper, routing said strip of paper and said mask through a bath of liquid barrier material, said liquid barrier material substantially saturating said strip of paper except for said first and second masked portions, and removing said mask from said strip of paper after moving said strip of paper and said mask out of said bath of liquid barrier material.

6. The paper bag as claimed in claim 17, wherein said mask is a pair of endless belts moving at a predetermined speed and said strip of paper is temporarily held between said mask and a first roller partially submerged in said bath of liquid barrier material.

* * * * *